US009545645B2

(12) United States Patent
Thomason

(10) Patent No.: US 9,545,645 B2
(45) Date of Patent: Jan. 17, 2017

(54) PAINT SPRAY BOOTH

(76) Inventor: Michael C. Thomason, Ecorse, MI (US)

( * ) Notice: Subject to any disclaimer, the term of this patent is extended or adjusted under 35 U.S.C. 154(b) by 1464 days.

(21) Appl. No.: 12/800,097

(22) Filed: May 7, 2010

(65) Prior Publication Data

US 2010/0293909 A1 Nov. 25, 2010

Related U.S. Application Data

(60) Provisional application No. 61/215,595, filed on May 7, 2009.

(51) Int. Cl.
*B05B 15/12* (2006.01)

(52) U.S. Cl.
CPC ..... *B05B 15/1262* (2013.01); *B05B 15/1248* (2013.01); *Y10T 29/49817* (2015.01)

(58) Field of Classification Search
CPC ..... B05B 15/1262; B05B 15/1248
USPC ..... 55/385.1, 385.2, 484, 485, 487, 508, 55/525, 488, 483, 486, DIG. 46; 118/305, 118/309, 312, 324, 326
See application file for complete search history.

(56) References Cited

U.S. PATENT DOCUMENTS 5,976,225 A * 11/1999 Nystrom et al. ..... 95/278
6,010,571 A * 1/2000 Josefsson et al. ..... 118/326
6,017,377 A * 1/2000 Brown et al. ..... 55/435
6,024,796 A * 2/2000 Salazar et al. ..... 118/326
6,093,250 A * 7/2000 Salazar et al. ..... 118/668
6,162,270 A * 12/2000 Nystrom et al. ..... 55/385.2
6,716,272 B2 * 4/2004 Hussey et al. ..... 95/216
6,723,169 B2 * 4/2004 Hihn et al. ..... 118/309
6,969,428 B2 * 11/2005 Guiduzzi et al. ..... 118/326
7,195,672 B2 * 3/2007 Ghilardi ..... 118/326

* cited by examiner

*Primary Examiner* — Duane Smith
(74) *Attorney, Agent, or Firm* — L.C. Begin & Associates, PLLC.

(57) ABSTRACT

A paint booth or paint booth system is presented having an upper and lower portion containing a flood plane panel located at the lower portion of the paint spray booth. An annular region is formed within the flood plane panel for receipt of a metal mesh filter removably fixed within the annular region and at least partially above the flood plane panel, for filtering of paint spray booth contents. The paint spray booth may also contain a perforated plate fixed over the filter for regulating the flow of air and bulk fluid through the filter.

8 Claims, 2 Drawing Sheets

PAINT SPRAY BOOTH

CROSS REFERENCE TO RELATED APPLICATIONS

The present application claims the benefit of U.S. Provisional Application Ser. No. 61/215,595 having a filing date of May 7, 2009.

BACKGROUND OF THE INVENTION

The present invention relates generally to a wet scrubber which captures and scrubs liquid or solid particles contained in an airflow, and also to a paint spray booth comprising the wet scrubber capable of capturing and scrubbing paint particles contained in a contaminated airflow discharged from the spray booth.

DESCRIPTION OF THE RELATED ART

Typically, painting of various kinds of mass-produced products such as car bodies and parts is carried out in a paint spray booth, in which an object to be painted is sprayed with the paint utilizing spray painting equipment. Paint that does not stick to the object to be painted floats in the air as paint mist. During the operation of such paint spray booths, it is necessary to continuously supply fresh outside air to, and to remove the paint mist from, the working area by means of a discharge air managing system. These serve the purpose of maintaining a safe and healthy working environment and assuring the highest quality of paint finish. The paint particles contained in this discharge air must be captured before the airflow exits to the atmosphere to avoid environmental pollution.

Known methods for separating paint mist from the air exhaust stream include: 1) a dry method in which the contaminated airflow is made to pass through a dry filter or screen and the paint particles contained therein are absorbed or trapped by the filter or the like; and 2) a wet method in which the contaminated airflow intimately intermingles with a liquid, such as water, such that the paint particles contained therein are captured and scrubbed by the liquid. Conventionally, in a paint spray facility for painting large products such as cars, the wet method is adopted.

There are various kinds of wet methods for separating paint mist. Typically, methods such as those described below are employed:

1. A method that utilizes the gravity difference between the airflow and a liquid such as water, thereby routing the airflow through the bulk liquid to capture paint particles contained in the airflow;
2. A method in which a liquid such as water spills downwardly, and the airflow is routed to pass through a liquid film formed thereby, to capture in the film paint particles contained in the flow;
3. A method in which a liquid such as water is sprayed to create a large population of liquid drops and the contaminated airflow is routed through this liquid mist where the liquid drops contact and capture the paint particles to be removed;
4. A method in which the airflow and a liquid such as water are routed through a restriction called a venturi. The turbulence of high-velocity air in the venturi causes break-up of the liquid into small drops that intercept and coalesce with the entrained paint particles; and 5. A method in which the flow of a liquid such as water is routed downwardly on a plate or the like and the airflow is made to blow on the plate, or, the airflow is made to impinge upon a pool of liquid such as water. Upon impact, the paint particles contained in the air stream, by virtue of a relatively greater momentum, are trapped on the surface of the liquid.

Typically, a discharge airflow from a paint spray booth consists of an airflow containing a paint mist that includes paint particles of various diameters. The diameters of these paint particles range from several hundred micrometers to less than one micrometer.

In conventional wet scrubbers used with a paint spray booth of a car assembly plant, various attempts have been made to improve scrubbing efficiency by increasing the frequency and the speed of the impacts of the discharge air stream flowing from the spray section against a capturing water flow. Increased energy costs and increased maintenance costs are often associated with such systems. Related thereto, U.S. Pat. Nos. 5,074,238, 5,040,482, 4,700,615, 4,664,060, 4,220,078, and the like disclose various proposals. U.S. Pat. No. 5,074,238 discloses a scrubber having a venturi opening through which a discharge airflow and water pass and a curved baffle where air and water mix. U.S. Pat. No. 5,040,482 discloses a scrubber having two troughs, which supply a sheet of water along an inclined surface and baffle to mix the water and paint-laden air. U.S. Pat. No. 4,700,615 discloses a scrubber in which several pools are provided hierarchically such that water runs through the pools in sequence, and a discharge airflow is routed through the plurality of water curtains that are formed. U.S. Pat. No. 4,664,060 discloses a scrubber in which a lip is provided in the rectangular venturi to increase the intermixing of the air and water, and a baffle plate is disposed below the venturi throat. U.S. Pat. No. 4,220,078 discloses a scrubber with a V-shaped impingement member disposed in the path of a discharge air-flow, and a shroud is provided around the collision to effect further scrubbing.

It has been found that attempts to scrub paint particles more efficiently tend to cause increased processing noise. Also, the necessity of increasing the capacity of an exhaust air fan or the like tends to increase equipment cost and energy consumption. Therefore, a device is needed that not only improves efficiency but also reduces noise and energy consumption as much as possible. Reduction of noise is desired from the standpoint of improving the working environment of an operator. U.S. Pat. No. 5,100,442 discloses a scrubber in which a discharge airflow and a water flow are directed into a venturi. The resultant mixture is then introduced into a restriction that defines a noise barrier thereby preventing noise caused by turbulent mixing from passing upstream. U.S. Pat. No. 5,020,470 discloses a scrubber having an elongated discharge tube through which discharge air and water flow. Particulate is removed by virtue of impact of the airflow with an impact pool. Little or no water dispersal or atomization occurs near the top of the discharge tube, and noise is abated. U.S. Pat. No. 4,515,073 discloses a scrubber having a serpentine path in which the air passes through the scrubbing fluid spray several times. A sound absorber is provided within baffles to reduce impact noise. U.S. Pat. No. 4,350,506 discloses a scrubber with a bell-shaped venturi portion that has an enlarged middle and a sound absorber is provided therein. U.S. Pat. No. 4,345,921 discloses a scrubber in which a pair of guide plates is provided in a venturi above the throat to form noise-muffling zones. An impact plate is positioned below the venturi throat and can contain a film or pool of water.

In certain prior-art scrubbers, a portion of the discharge airflow can pass outside the scrubber with little or no mixing with water, and thus can still contain paint particles. Further, the splash of water at a pool can cause contaminated paint overspray treatment fluid drops to be discharged with the air via the exhaust air fan. A device to change the direction of the discharge airflow for the purpose of enhancing the scrubbing of paint particles from a paint mist has been proposed in U.S. Pat. No. 4,704,952, for example. This patent discloses a scrubber having structures through which paint-laden air and water downwardly and mix together. Partitions outside the structures cause the air to turn abruptly upwardly and then reverse in a lateral direction. The air passes through baffles and then is discharged into the atmosphere.

As shown in U.S. Pat. Nos. 6,093,250 and 6,024,796, herein incorporated by reference, in known paint spray booths, the aqueous or fluidized curtain and paint laden air is typically funneled through floor grates at the bottom of the booth. The mixture then proceeds down the flood sheets and through high pressure mixing and vortex chambers to facilitate contact between the paint overspray and the aqueous/chemical mixture. It has been found that a chemical treatment bulk fluid employing oil-in-water emulsions or chemical mixtures such as that described in U.S. Pat. No. 4,919,691, also herein incorporated by reference, is quite effective in removing the paint solids from the air and simultaneously inhibiting the buildup of paint solids throughout the paint spray booth, both above and below the floor grates. Fluidized curtains, bulk fluid spray, and the like exemplify how paint overspray may be entrained within the bulk fluid in a known manner. The volatile nature and low density of the oil, when combined with the high pressure of the vortex chamber, however, creates a mist or fog that is often vented through the paint stack if not properly filtered as the mist is vented. Accordingly, although the oil/water emulsion of U.S. Pat. No. 4,919,691, herein incorporated by reference, or any equivalent thereof, is a preferred chemical treatment of the paint overspray, there is presently a concern of inhibiting the deposition or collection of the oil mist in areas other than about the paint spray booth.

Although the prior art discloses many wet scrubbers, there still remains room for improvement. For example, many state of the art wet scrubbers utilize relatively high pressure systems that result in a large consumption of energy and increased noise. Further, some conventional wet scrubbers still have relatively low efficiency when capturing very small paint particles in the bulk fluid chemical used to treat paint overspray, therefore presenting the problem of allowing part of the paint mist to be discharged to the environment. As such, a large amount of paint-laden bulk fluid drops may then be discharged through associated air fan devices to the atmosphere. As a result, more efficacious chemical treatment of the paint overspray, such as that provided by oil/water emulsions is complicated due to volatilization and expulsion of the same, as emissions from the plant into the outside environment. Further, the construction of paint spray booths and the associated wet method treatment system may be unduly complicated thereby complicating manufacturing requirements and raising the associated manufacturing and operating costs.

SUMMARY OF THE INVENTION

The above-referenced concerns are resolved by a paint spray booth employing a wet method and therefore a bulk fluid to treat paint overspray. One or more walls, and typically a plurality of walls, define a paint spray booth or a containment area for painting an article such as a vehicle. A flood plane or flood plane panel is proximate to, adjoined to, or included within the one or more walls of the paint spray booth, and provides an area where bulk fluid is drained from the paint spray booth, and/or, wherein bulk fluid communicates therewith. A filter having a top portion and a bottom portion is removably positioned at least partially above and within an annular or open portion of the flood sheet or flood plane panel. The filter provides a relatively large area for filtration of the bulk fluid as it drains from the paint spray booth. The filter may, for example, be assembled by a tongue and groove relationship formed between the filter (grooved side edges) and the flood plane panel (the flood plane panel edges inherently comprising tongued edges).

When assembled, the filter thereby fits within an annular or rectangular opening in the flood plane panel. The filter is made from a fine mesh, and preferably a metallic mesh. The bulk fluid passes through the filter into a lower region or reservoir beneath the paint spray booth for recirculation back through an associated system, such as a bulk fluid reservoir. If desired, one or more splash panels angularly or orthogonally extend from an area of the paint spray booth that is adjacent to the bottom portion of the filter, into the lower region of the paint spray booth. As the bulk fluid passes through the filter, the splash panel(s) directs the flow of bulk fluid into lower reservoir beneath the paint spray booth for recirculation back into the system.

In sum, the present invention may be described as a paint booth or paint booth system having an upper and lower portion containing a flood plane panel located at the lower portion of the paint spray booth. An annular region is formed within the flood plane panel for receipt of a metal mesh filter removably fixed within the annular region and at least partially above the flood plane panel, for filtering of paint spray booth contents. The paint spray booth may also contain a perforated plate fixed over the filter for regulating the flow of air and bulk fluid through the filter.

DETAILED DESCRIPTION OF THE PREFERRED EMBODIMENT

A paint spray booth is constructed as known in the art. For example only, and not by way of limitation, a paint spray booth may be constructed as described in U.S. Pat. Nos. 6,093,250 and 6,024,796, each herein incorporated by reference. As such, typical operation of any paint spray booth is contemplated. However, in accordance with the present invention, the treatment of the overspray is mechanically modified to result in a reduction in energy, maintenance, equipment, manufacturing, and/or related paint shop costs.

In accordance with the present invention, it has been discovered that effective treatment of the paint overspray can be accomplished by modifying known paint spray booths to incorporate relatively low pressure mixing and treatment of the bulk fluid and the paint overspray, respectively, rather than the relatively high pressure mixing attendant to the vortex chamber as illustrated in U.S. Pat. Nos. 6,024,796 and 6,093,250. Accordingly, a paint spray booth constructed in accordance with the present invention will incorporate a metal mesh filter, woven or sintered for example, and positioned in a plane residing above at least a portion of an adjacent flood sheet or flood plane panel, in lieu of the vortex chamber or acceleration cone incorporated in U.S. Pat. No. 6,024,796, for example. Other metal matrix filters are also contemplated wherein the preferred metal is of the stainless steel variety.

In further accordance with the present invention, a method of treating paint overspray is provided, the method including the following steps:

- providing a bulk fluid for treating the paint overspray;
- providing a filter removably positioned within the floor of a flood plane sheet or panel; and
- directing at least a portion of the paint overspray and bulk fluid through the filter and into a reservoir positioned beneath the paint spray booth.

A method of constructing or retrofitting a paint spray booth is also provided wherein the method includes the following steps:

- providing a paint spray booth containing one or more flood sheets or flood plane panels;
- cutting one or more portions of the one or more flood plane panels, each portion consisting of a predetermined area, and each portion corresponding to an open area created by the removal of the portion;
- installing a wire mesh or metallic mesh filter, or an equivalent thereof, into each open area; and
- sealing the interface between each filter and each open area, wherein the seal may be a rubber gasket for example. The seal may in fact be fixed to the periphery of the upper or bottom portion of the filter, whereby when the filter is removed, so is the seal.

Figure 1:
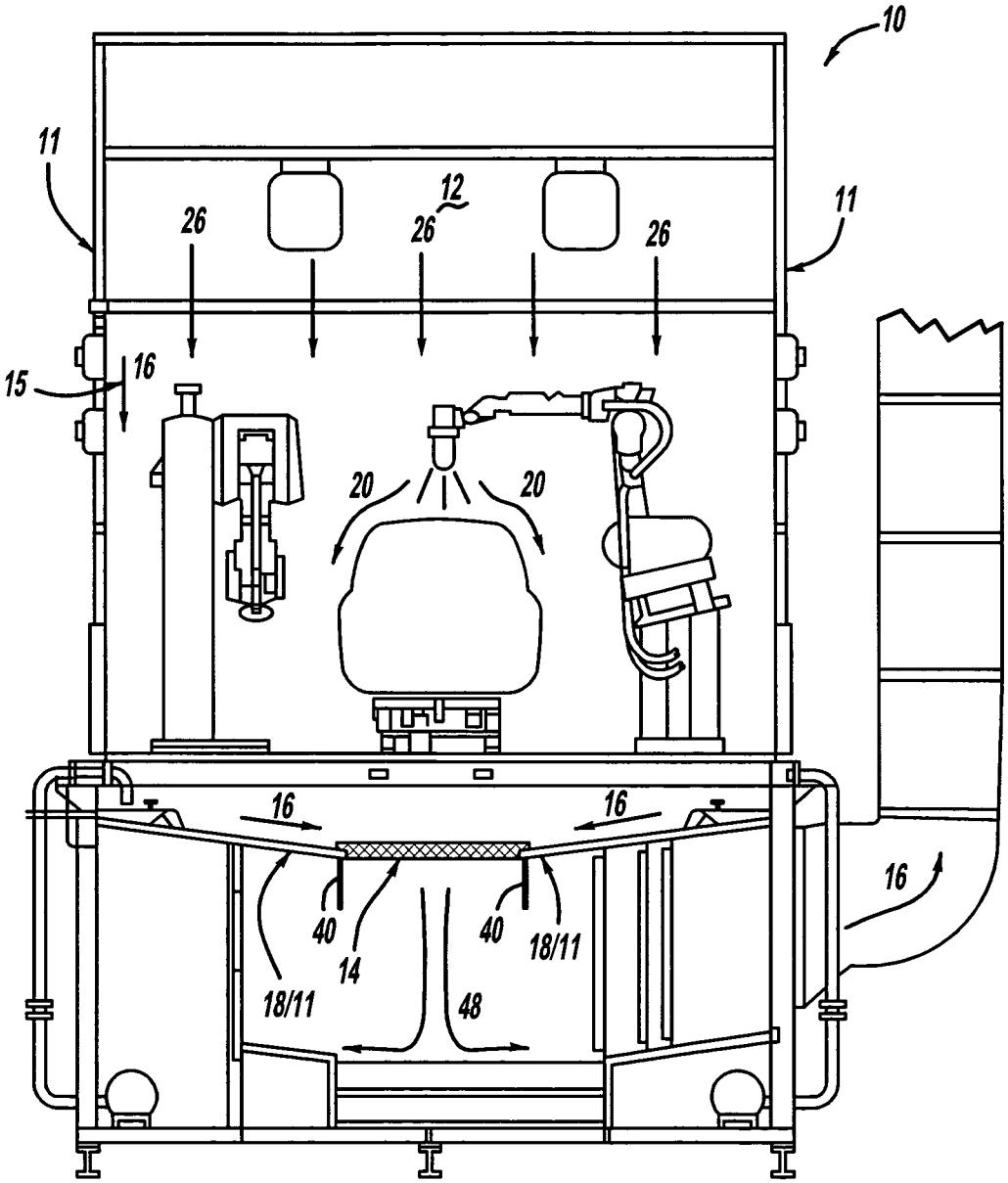
FIG. 1 exemplifies a paint spray booth in accordance with the present invention.

Accordingly, as shown in FIG. 1, one or more walls 11, and typically a plurality of walls, define a paint spray booth 10 or a containment area for painting an article such as a vehicle. A flood plane sheet or flood plane panel 18 is proximate to, adjoined to, or included within the one or more walls of the paint spray booth 10, and provides an area where bulk fluid is drained from the paint spray booth 10, or, wherein bulk fluid communicates therewith. A filter 14 having a top portion 15 and a bottom portion 17 is removably positioned at least partially above and within an annular or open portion 36 of the flood sheet or flood plane panel 18, and provides a relatively large area for filtration of the bulk fluid as it drains from the paint spray booth 10. The filter 14 may, for example, be assembled by a tongue and groove relationship formed between the filter (grooved side edges) and the flood plane panel 18 (the flood plane edges inherently comprising tongued edges).

Figures 2, 3:
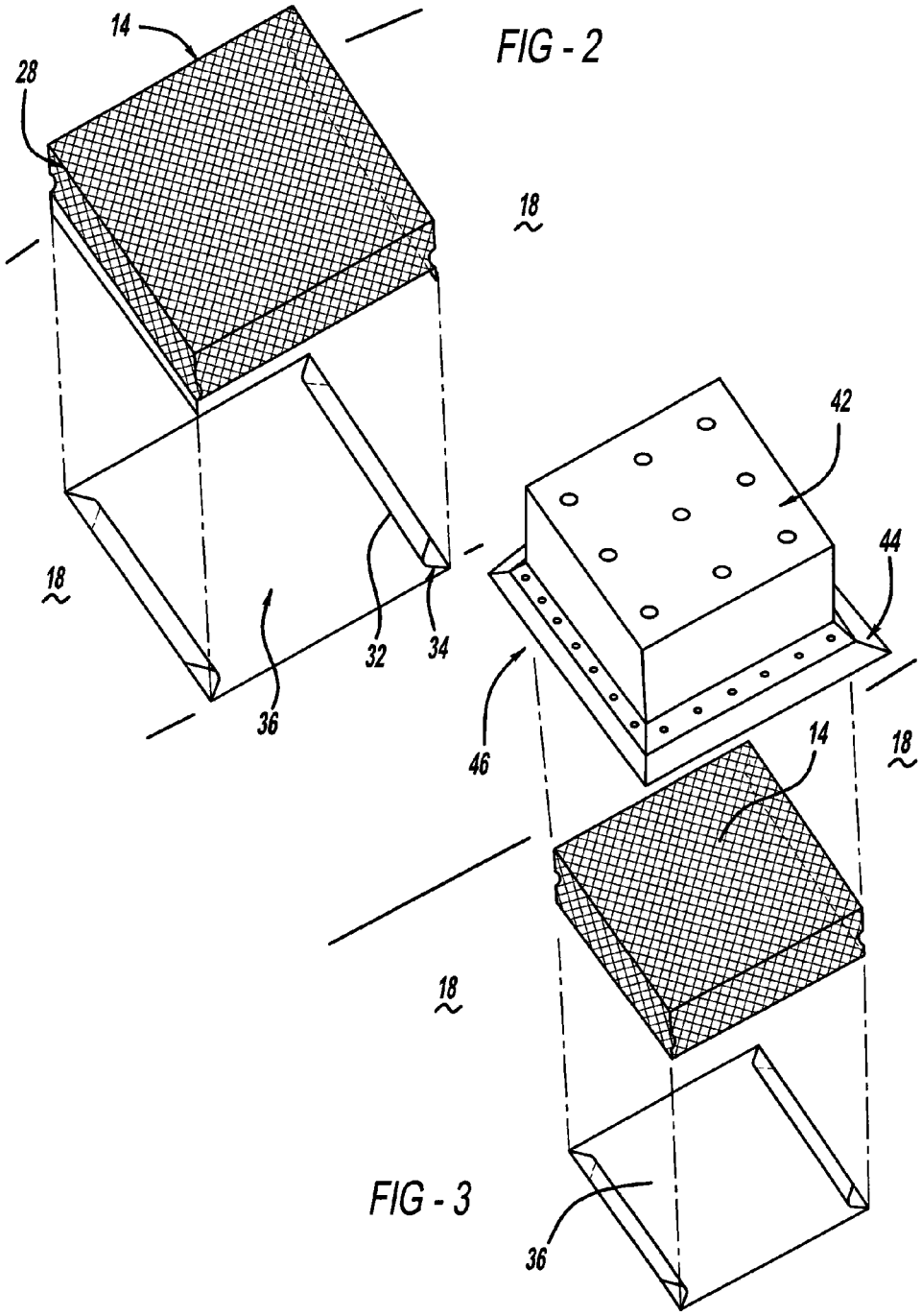
FIG. 2 exemplifies the filter and the associated annular region of the flood plane panel in an exploded view.
FIG. 3 is an exploded view that exemplifies the filter and the associated annular region of the flood plane panel, and a perforated cover and an associated seal for sealing of the filter when installed within the annular region of the flood plane panel.

As shown in FIG. 2, a first peripheral edge 28 of the filter 14 may have a groove 30 formed about at least a portion of the first peripheral edge 28 of the filter 14. An inner annular wall 32 formed about the inner periphery 34 of the annulus 36 in the flood sheet 18 may contain a corresponding tongue or protrusion 38 extending radially inward and formed at least partially about the inner annular wall. As the filter groove 30 is mated with the flood plane protrusion 38, the filter 14 is thereby installed above the floor of the flood plane in a tongue and groove relationship with the inner peripheral wall 34 of the annulus 36.

In one embodiment, the filter 14 may for example extend completely above the flood sheet 18, and preferably from three to six inches above the surface of the flood plane panel 18, and even more preferably from about five and a half inches above the flood plane panel 18. The filter 14 is thereby assured to be immersed within the flood plane as the level of the bulk fluid rises over the flood sheets 18. It has been found that filtration through the filter 14 is more efficient when the filter 14 is elevated above the flood sheet 18, and it is believed that the residence time of the bulk fluid/paint mixture is slightly increased over the flood plane panels 18, thereby providing a more sedentary flow through the filter 14.

When assembled, the filter 14 thereby fits within an annular or rectangular opening 36 in the flood plane panel 18. The filter 14 may be made from a fine mesh, and preferably a metallic mesh. The bulk fluid passes through the filter 14 into a lower region or reservoir 48 beneath the paint spray booth 10 for recirculation back through an associated system, such as a bulk fluid reservoir. If desired, one or more splash panels 42 angularly or orthogonally extend from an area of the paint spray booth 10 that is adjacent to the bottom portion 17 of the filter 14, into the lower region of the paint spray booth 10. As the bulk fluid passes through the filter 14, the splash panel(s) directs the flow of bulk fluid into lower reservoir beneath the paint spray booth 10 for recirculation back into the system.

In yet another aspect of the invention, a perforated enclosure or panel 42 may be bolted or otherwise fixed over the filter 14, thereby providing a greater retention time within the flood plane area while yet protecting the filter 14 from any copious blocking due to paint solids for example. The perforations 43 of the panel 42 may be iteratively varied depending on what air velocity is desired in the paint booth 10. Furthermore, the perforated panel 42 may be formed with a seal or flange 44 about its outer periphery 46 whereby when the perforated panel 42 is bolted or otherwise fixed to the flood plane panel 18, the perforated panel 42 forms a sealed relationship with the flood plane panel 18.

The filter mesh or the degree of filtration may be varied as determined by local design criteria. Accordingly, the total surface area and the total interstitial area defined by the filter type may be determined on an iterative basis by measuring the pressure drop across the filter and optimizing the filtration mesh based on design requirement.

It will be appreciated that the filter 14 may be readily cleaned or replaced as necessary to maintain the bulk fluid and air flow within system design tolerances. The filter 14 may, for example, be assembled by a tongue and groove relationship formed between the filter 14 (wherein the filter has grooved side edges) and the flood plane panel 18 (wherein the flood plane panel edges inherently comprise tongued edges for mating with the grooved side edges of the filter). When the filter 14 reaches capacity, the filter 14 may be slid from its berth on the edges of the flood plane panel open area 36, and a clean one may be immediately installed, thereby reducing the time needed to maintain the paint spray booth 10. Alternatively, the filter 14 may simply be inverted to expose a cleaner surface from the bottom 17 of the filter 10, whereby the former upper surface 15 now becomes the bottom surface 17 for cleaning thereof. The filter 14 may be supplied by a myriad of suppliers who provide metallic weave filters in pleated or non-pleated form. One such company includes Metal Filters, Inc. from Lorain, Ohio 44053, for example.

Furthermore, one of ordinary skill in the art will also appreciate that the high pressure typically found in venturi systems, for example, is not necessary for optimum paint overspray/bulk fluid contact, particularly in view of the relatively large aggregated surface area of the filter and the resultant overspray/bulk fluid contact. Other structures typically associated with paint spray booths may be utilized in conjunction with the "filter/flood sheet assembly" to include mist eliminators and baffle system, for example. U.S. Pat. No. 4,704,952 exemplifies the use of such structures and is incorporated herein by reference. In essence, the use of the filter combined with other known paint spray booth structure results in the elimination of mist and emissions flowing out of associated ventilation or paint stacks.

In accordance with the present invention, and again referring to FIG. 1, a paint spray booth 10 is exemplified, but not thereby limited. One or more walls 11 define the containment area 10 for containment of the painting operation. A paint spray booth 10 may be employed to paint an article such as an automobile while moving along a conveyor line passing through the working area of the booth 10. Air 26 is typically moved or directed from an area 12 above the article downwardly around the article for discharge into and through a filter 14 positioned along a center line of the booth 10, for example. Other configurations may be utilized wherein more than one filter 14 is assembled within the flood plane panel and employed within the booth 10. Accordingly, another configuration (not shown) within an automotive paint spray booth 10 might, for example, include a pair of filters existing in a plane coplanar or substantially parallel to the flood sheet or flood plane panel, herein each filter 14 is located beneath each respective rocker panel. As such, at least one filter 14 may be employed in a paint spray booth 10 of the present invention. In any design, bulk fluid 16 is supplied to a pan or flood plane or flood plane panel(s) 18 positioned beneath the articles or vehicle whereby the bulk fluid 16 cascades downward through the filter(s) 14, in fluid communication therewith. Concurrently, therewith, paint overspray 20 may be directly carried onto the pan(s) 18 by forced air 26 and then through filter 14 for contact and for mixing of the paint overspray with bulk fluid 16. Alternatively, or at the same time, paint overspray 20 may also be entrained within bulk fluid 16 in a known manner (exemplified by a fluidized curtain 15) and then supplied to flood sheets or pan(s) 18 whereby the bulk fluid 16 is then drained through filter(s) 14.

One or more benefits may be associated with the present invention, depending on the specific application. For example, it has been found that chemical stability of the bulk fluid with an increased amount of solids is enhanced. Further, other benefits include: reduced energy costs due to a reduction in pressure across the filter as compared to venturi systems; reduced filter costs; reduced water loss due to reduced evaporation; reduced maintenance or booth cleaning costs due to more efficient treatment of the paint overspray; and other cost improvements. Accordingly, paint spray booths incorporating the filter 14 of the present invention will typically observe one or more of the benefits stated. The filter 14 may be provided, for example, by N.S. Technologies, Inc. as described in U.S. Pat. No. 6,162,270, herein incorporated by reference.

It will be understood that the foregoing description of the preferred embodiment of the present invention is for illustrated purposes only. As such, the various structural and operational features herein disclosed are susceptible to a number of modifications commensurate with the abilities of one of ordinary skill in the art, none of which departs from the scope of the present invention as described above and as stated in the claims appended hereto.

What is claimed is:

1. A paint spray booth having an upper and lower portion comprising:

a flood plane panel located at the lower portion of the paint spray booth;

an annular region formed within said flood plane panel; and a metal mesh filter removably fixed within said annular region and at least partially above said flood plane panel, for filtering of paint spray booth contents.

2. The paint spray booth of claim 1 further comprising:

a perforated plate fixed over said filter for regulating the flow of air and water through said filter.

3. The paint spray booth of claim 2 wherein said perforated plate is bolted to said flood plane panel in a sealed relationship thereto.

4. A paint spray booth having an upper and lower portion comprising:

a flood plane panel located at the lower portion of the paint spray booth;

an annular region formed within said flood plane panel, the annular region having an inner peripheral wall; and a metal mesh filter having an outer periphery, said metal mesh filter removably fixed within the inner peripheral wall of said annular region, said metal mesh filter extending above said flood plane panel for filtering of paint spray booth bulk fluid.

5. The paint spray booth of claim 4 wherein said metal mesh filter extends from three to six inches above said flood plane panel.

6. The paint spray booth of claim 4 wherein said inner peripheral wall has a protrusion or tongue, and said metal mesh filter has a groove extending about its outer periphery, said inner peripheral wall and said metal mesh filter fixed in a tongue and groove relationship.

7. The paint spray booth of claim 1 wherein said metal mesh filter is sealed within said annular region.

8. The paint spray booth of claim 4 further comprising a seal between said inner annular peripheral wall and said outer wall.

* * * * *